US007449646B1

(12) United States Patent
Wechtenhiser et al.

(10) Patent No.: US 7,449,646 B1
(45) Date of Patent: Nov. 11, 2008

(54) ELLIPTICAL PNEUMATIC ACTUATOR WITH A WEDGE SHAPED BASE

(75) Inventors: Bert W. Wechtenhiser, Jacksonville, FL (US); Mack Wright, Jacksonville, FL (US); James A. King, Jacksonville, FL (US)

(73) Assignee: Dwyer Precision Products, Inc., Jacksonville, FL (US)

( * ) Notice: Subject to any disclaimer, the term of this patent is extended or adjusted under 35 U.S.C. 154(b) by 0 days.

(21) Appl. No.: 11/893,790

(22) Filed: Aug. 17, 2007

(51) Int. Cl.
*H01H 35/36* (2006.01)

(52) U.S. Cl. ..... 200/81 H; 200/81 R; 200/83 R; 340/442; 340/445; 73/146

(58) Field of Classification Search ..... 200/81 H, 200/81 R, 83 R, 83 W, 83 Z, 329, 81.6, 81.9; 340/442, 445, 447, 573, 626; 73/146, 745
See application file for complete search history.

(56) References Cited

U.S. PATENT DOCUMENTS 3,823,285 A * 7/1974 Dwyer ..... 200/81 H
5,113,048 A * 5/1992 Lafferty ..... 200/83 Z
D339,570 S * 9/1993 Dwyer ..... D13/173
5,461,207 A * 10/1995 Van Lear ..... 200/81 H
5,699,041 A * 12/1997 Ballyns ..... 340/442
5,736,702 A * 4/1998 Roberts et al. ..... 200/81 H

* cited by examiner

*Primary Examiner*—Kyung Lee
(74) *Attorney, Agent, or Firm*—Clifford A. Poff

(57) ABSTRACT

A pneumatically actuated switching device has an elliptical dome with spaced apart support columns protruding from a concave inner face surface for anchoring to a floor of a wedge shaped base. The base is elliptical and bounded by an endless upstanding sidewall having a projected edge that varies continuously in height about one of the major axis and the minor axis, the projected edge having one of a channel and a locking lip and the other of the channel and the locking lip being formed on the elliptical edge for interlocking engagement in an air tight fashion. An electrically conductive switch is coupled by a duct for responding to a volume of pressurized air within the dome and the base by deflection of the convex actuating wall.

11 Claims, 7 Drawing Sheets

ELLIPTICAL PNEUMATIC ACTUATOR WITH A WEDGE SHAPED BASE

CROSS-REFERENCE TO RELATED APPLICATIONS

Design patent application Ser. No. 29/289,463, filed Jul. 21, 2007

BACKGROUND OF THE INVENTION

The present invention relates to a pneumatically actuated switching device, and more particularly, to an improved construction and arrangement of parts to form an enlarged pneumatic bulb with a sloping and ultra sensitive tactility for delivering a quantity of pressurized air sufficient to actuate an electrical switch in a nurse call system.

Pneumatic bulbs such as disclosed in U.S. Pat. Nos. 3,823,285 and 5,155,309 are used to generate a volume of pressurized air sufficient to operate an electrical switching circuit in a nurse call system. A system of this type is particularly useful in environments where it is undesirable to use a conventional electrical switch because of a possible catastrophic explosion when an exposed switching circuit operates in an atmosphere containing a high concentration of a potentially explosive gas. Such an atmosphere commonly occurs in hospital, nursing and assisted living facilities due to a patient's use of oxygen. A patient actuated call system is particularly needed in facilities where there is a need or desire by a person to summon for help, particularly, when a patient is in a weakened or disabled condition. Most hospitals and health care institutions today have signaling systems by which in each patient area a patient may initiate a signal that is received by a station or at an allocated substation within a larger area to summon assistance. Typically, for example, in a hospital a select group of patient areas is serviced by a given nurse station where calls for assistance by patients are taken. Most patient areas must accommodate the use of oxygen even if it is only on an emergency basis whereby electrical switches commonly used in other industries cannot be utilized. A need, however, exists for a pneumatic bulb construction that is well suited for the environment of use particularly in a patient environment where the patient has severely restricted mobility capabilities and therefore must assume that the pneumatic device will remain in place without random or uncontrolled movement. For example, a pneumatic bulb illustrated in U.S. Pat. No. 3,823,285 has hemispherical end parts adjoined with a cylindrical mid-section. The cylindrical configuration of the pneumatic bulb and patient movement result in the fundamental instability of the bulb on a flat surface and cannot be relied upon to remain in a fixed or desired location on a patient's mattress. A more recent construction of a pneumatic bulb is disclosed in U.S. Pat. No. 5,155,309 and uses a base plate to provide a broad area of support for a peripheral rim and a center post of an actuator dome. The base plate has protrusions on the support surface to allow the bulb to remain at a desired designated area with great reliability and integrity for operating a switching device. The dome resembles the appearance of a doughnut and the use of a center post to establish the defining configuration establishes to requirement for an elastic compression of the bulb that may exceed the capabilities of a patient having severely limited physical capabilities.

Examples of other known nurse call systems can be found in U.S. Pat. Nos. 4,702,443; 4,484,367; 4,298,863; and 3,781,843. In U.S. Pat. No. 4,702,443, a cord holding device is disclosed wherein a belt fastener is used to hold a base onto a mattress so that the base can in turn receive a cord-holding member. The cord-holding member supports a cord to allow limited movement of the cord the end of which carries a push button electric switch. In U.S. Pat. No. 4,484,367, a side rail of a patient's bed is wrapped with a flexible sheet having a pocket in one side of the sheet for receiving an electronic push button device serving as a call device for summoning a nurse. U.S. Pat. No. 4,298,863 discloses a patient call system in which a patient operated transducer is mounted on a patient's face or a portion of the body. The transducer is interconnected by pneumatic tubing to a pneumatically actuated switch that is part of an electronic monitoring system. U.S. Pat. No. 3,781,843 discloses a bed guard system in which the upper rail surfaces of patient restraining rails at opposite sides of a bed are fitted with a detector. Each detector is formed with an elongated rail engaging pocket shape to fit on the rail surface and an overlying elongated internal cavity extending generally the length of the rail. In internal cavity forms a site for a fluid material which can be pressurized by an applied pressure to the top surface of the rail covering.

Accordingly, it is an object of the present invention to provide a pneumatic actuator with an improved shape for patients access to an enlarged actuator dome providing a sloping ultra sensitive tactility for ease of use by all elderly or geriatric and convalescent care patients.

It is a further object of the present invention to provide a pneumatic bulb embodying a construction such that a wedge shaped base has an upstanding support wall to an elliptically shaped actuator dome with an enlarged surface area so as to minimize the effort required to pressurize a volume of air needed to operate a call system for summing assistance or help.

It is another object of the present invention to provide a pneumatic bulb embodying an elasticity and volume enclosed by the pneumatic bulb such that it makes it much easer for a patient with limited physical capabilities to activate pneumatic bulb by brushing against it with an area of the cheek or head and could be placed almost any where that motion can be directed to activate a call for assistance.

SUMMARY OF THE INVENTION

More particularly, according to the present invention there is provided a pneumatically actuated switching device comprising a dome with a convex actuating wall terminating at an elliptical edge and including spaced apart support columns protruding from a concave inner face surface of the convex actuating wall, a base including receptacles for anchoring the support columns to a floor bounded by an elliptical perimeter symmetrical about each of a major axis and a minor axis and joined to an endless upstanding sidewall having a projected edge that varies continuously in height about one of the major axis and the minor axis, the projected edge having one of a channel and a locking lip and the other of the channel and the locking lip being formed on the elliptical edge for interlocking engagement in an air tight fashion, and an electrically conductive switch coupled by a duct for responding to a volume of pressurized air within the dome and the base by deflection of the convex actuating wall.

Preferably, the spaced apart support columns of the pneumatically actuated switching device have free ends containing enlargements defining anchor knots and the receptacles include apertures for receiving the anchor knots. The projected edge of the upstanding sidewall preferably varies continuously in height about the minor axis and by a ratio of 3 to 1 such that there is defined a wedge shaped configuration to the base. The concave inner face surface of the convex actuating wall includes ribs for self-sustaining support of the convex actuating wall terminating at an elliptical edge.

BRIEF DESCRIPTION OF THE SEVERAL VIEWS OF THE DRAWINGS

The present invention will be more fully understood when the following description is read in light of the accompanying drawings in which.

DETAILED DESCRIPTION OF THE INVENTION

Figure 1:
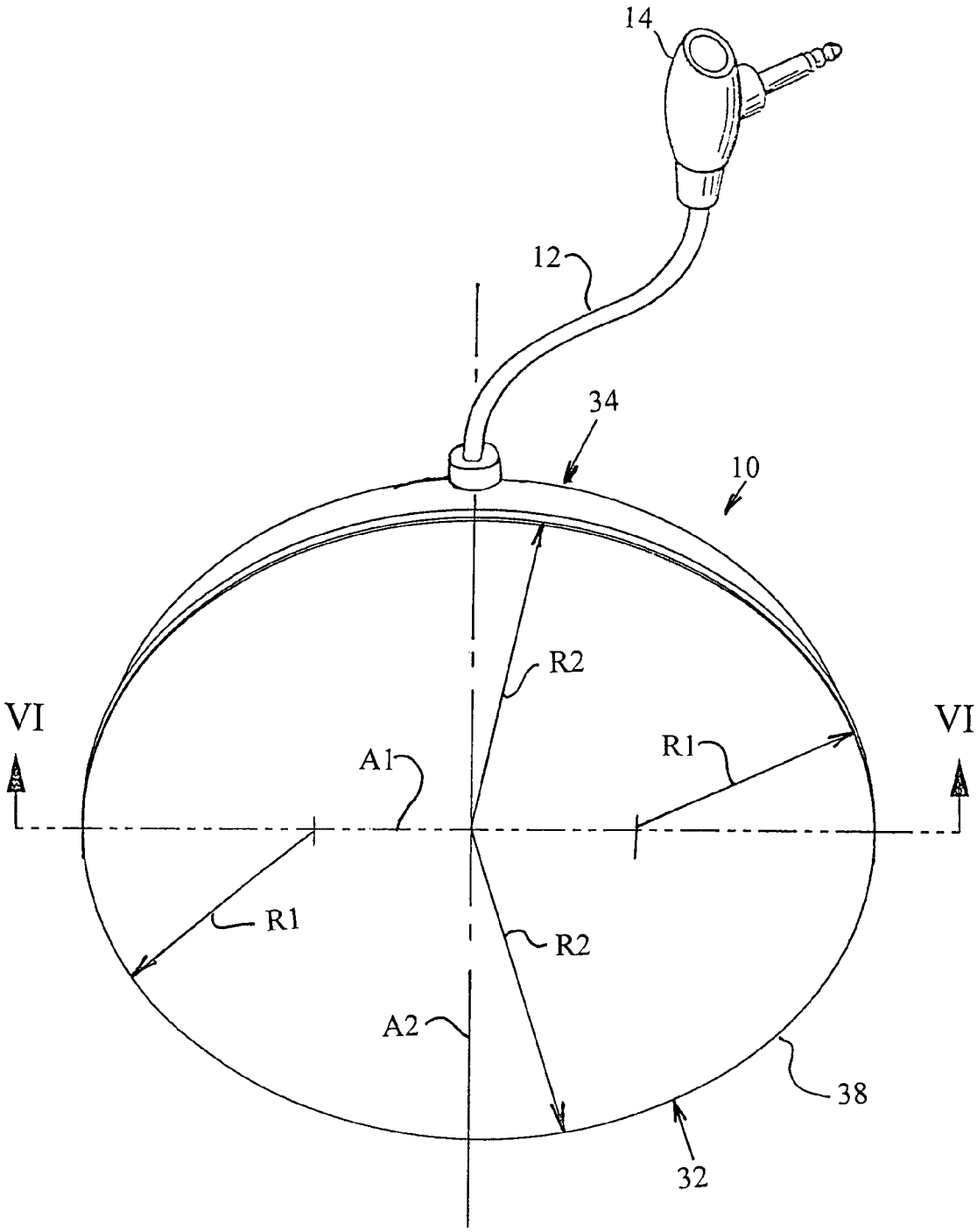
FIG. 1 is a top plan view of the elliptical pneumatic actuator with a wedge shaped base according to the present invention.
Figure 3:
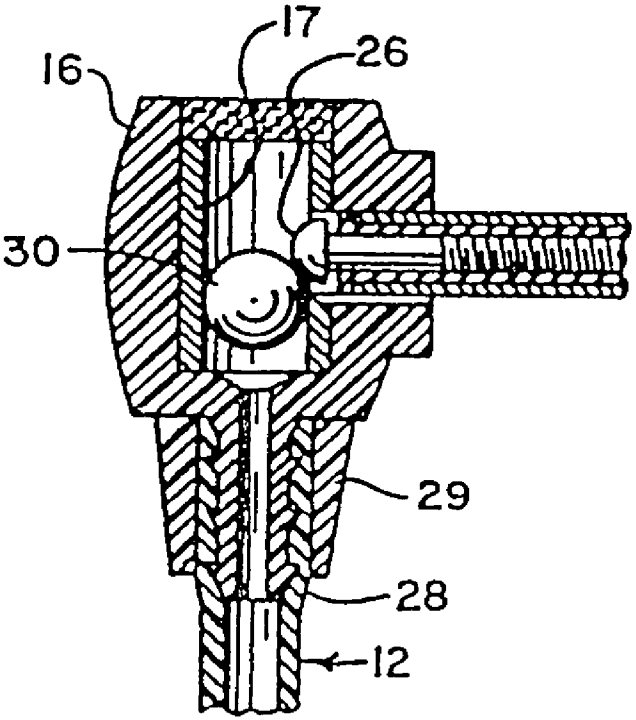
FIG. 3 is a view similar to FIG. 2 and illustrating the actuator ball in a closed circuit position.
Figure 2:
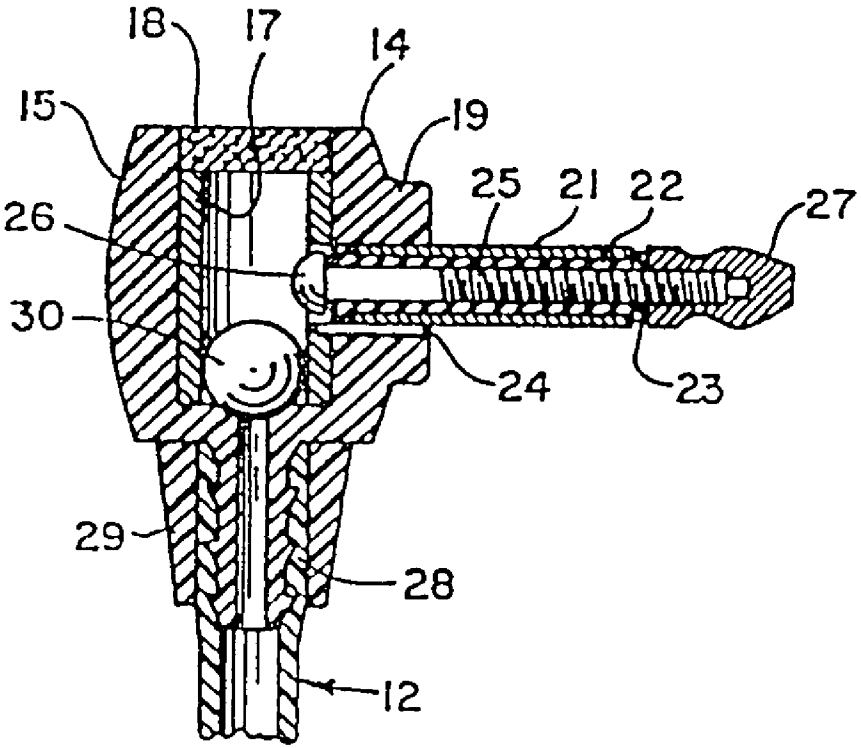
FIG. 2 is a sectional view of the pneumatically actuated switching device shown in FIG. 1 with the actuator ball in a position for an open circuit.
Figure 4:
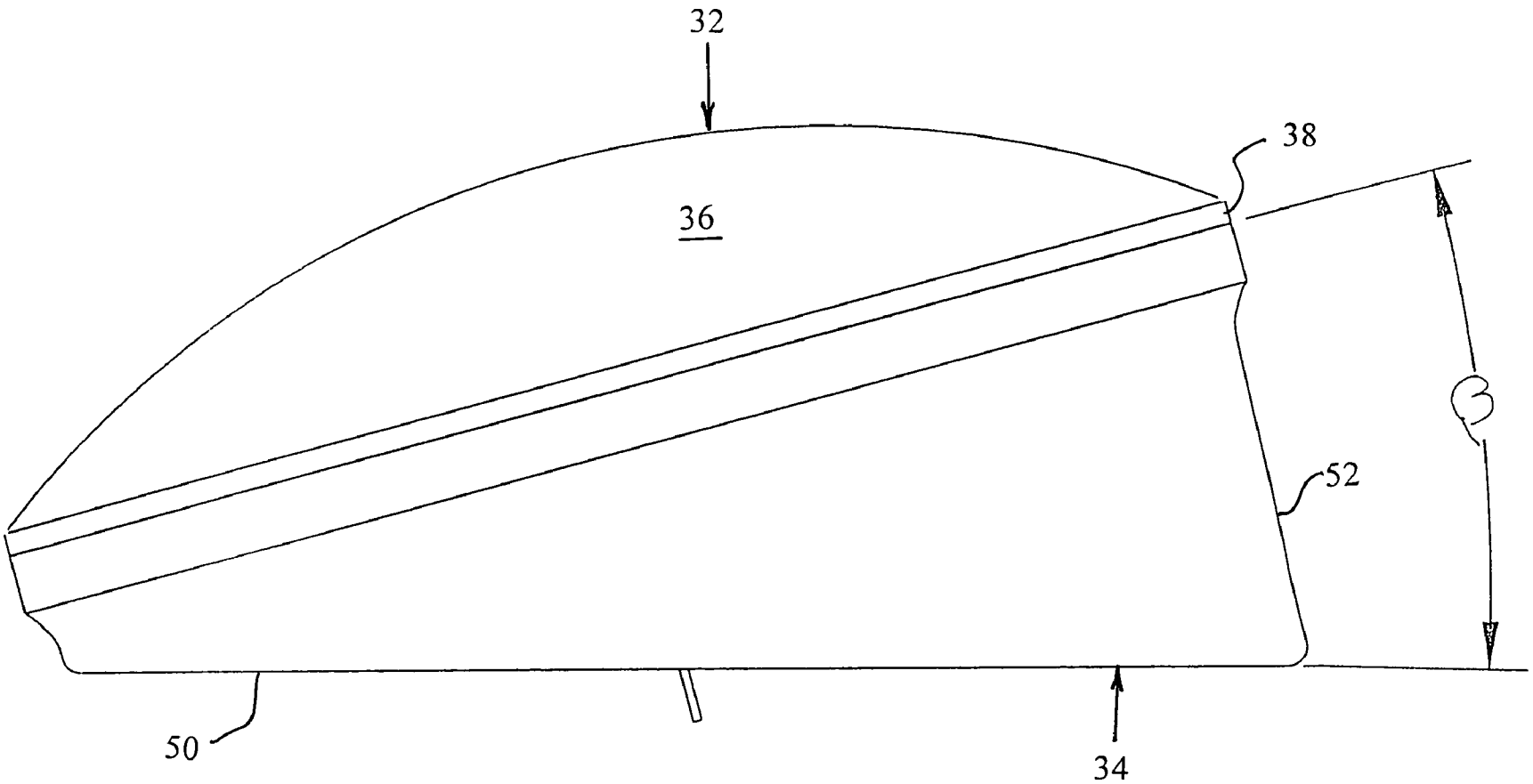
FIG. 4 is a right side elevation view of the actuator shown in FIG. 1.
Figure 5:
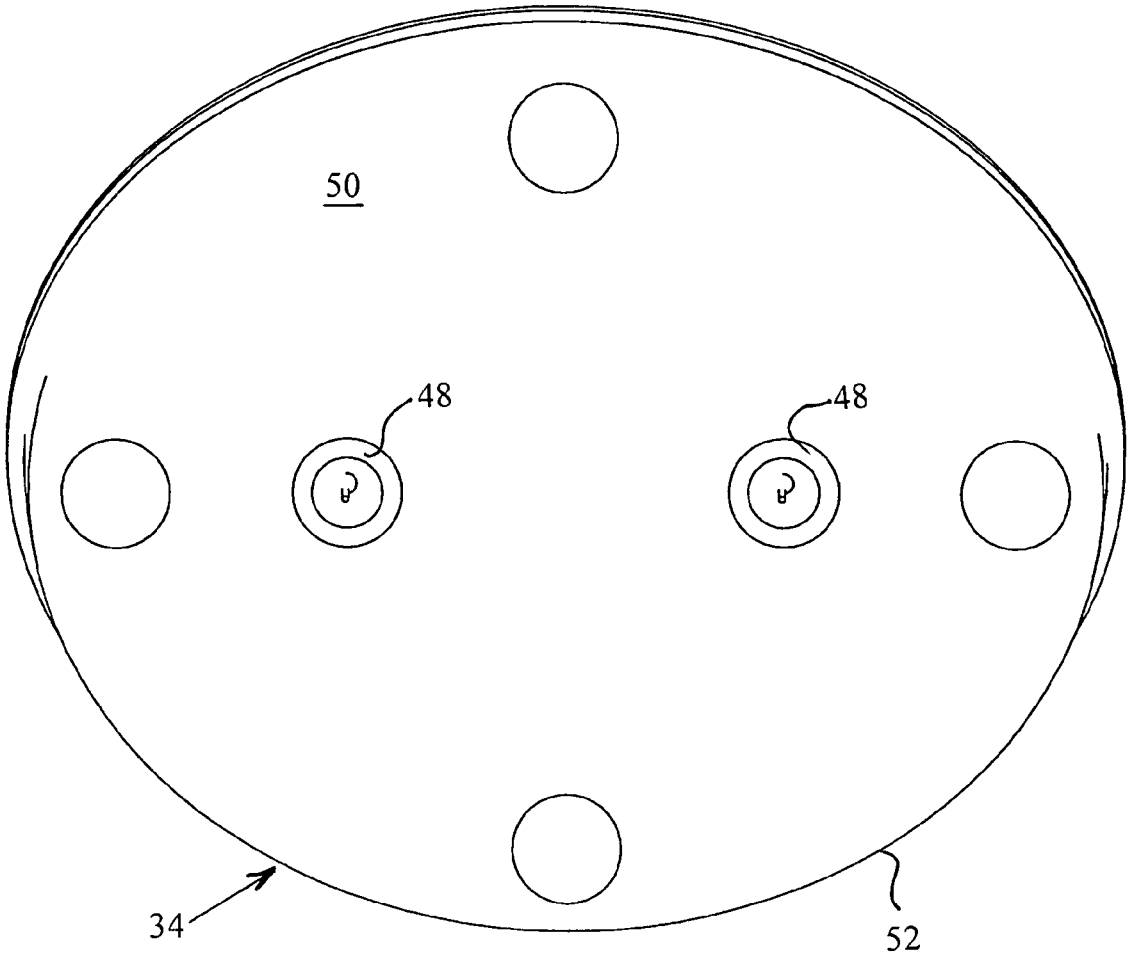
FIG. 5 is a bottom plan view of the actuator shown in FIG. 1.
Figure 6:
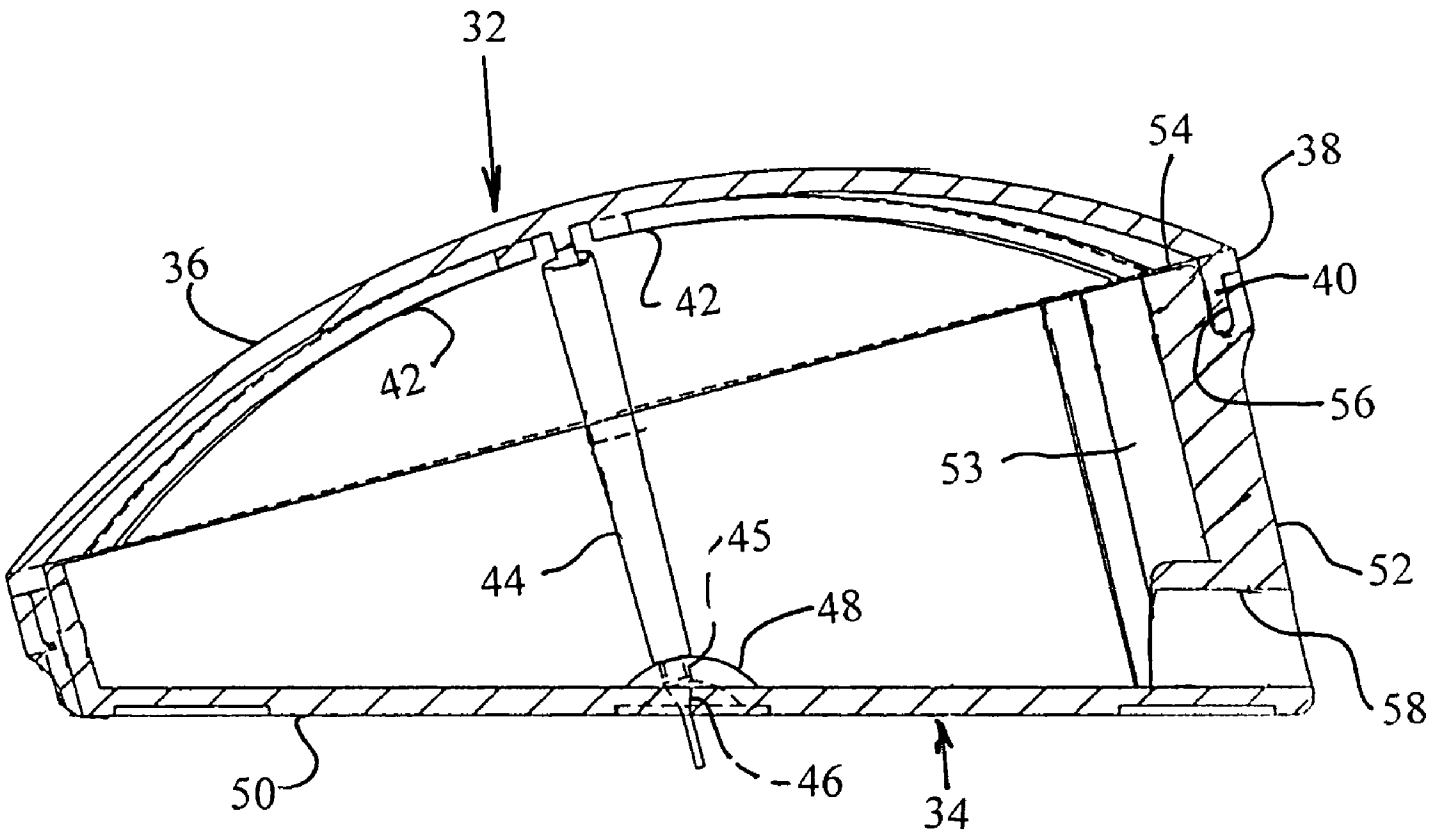
FIG. 6 is a sectional view taken along lines VI-VI of FIG. 1.
Figure 7:
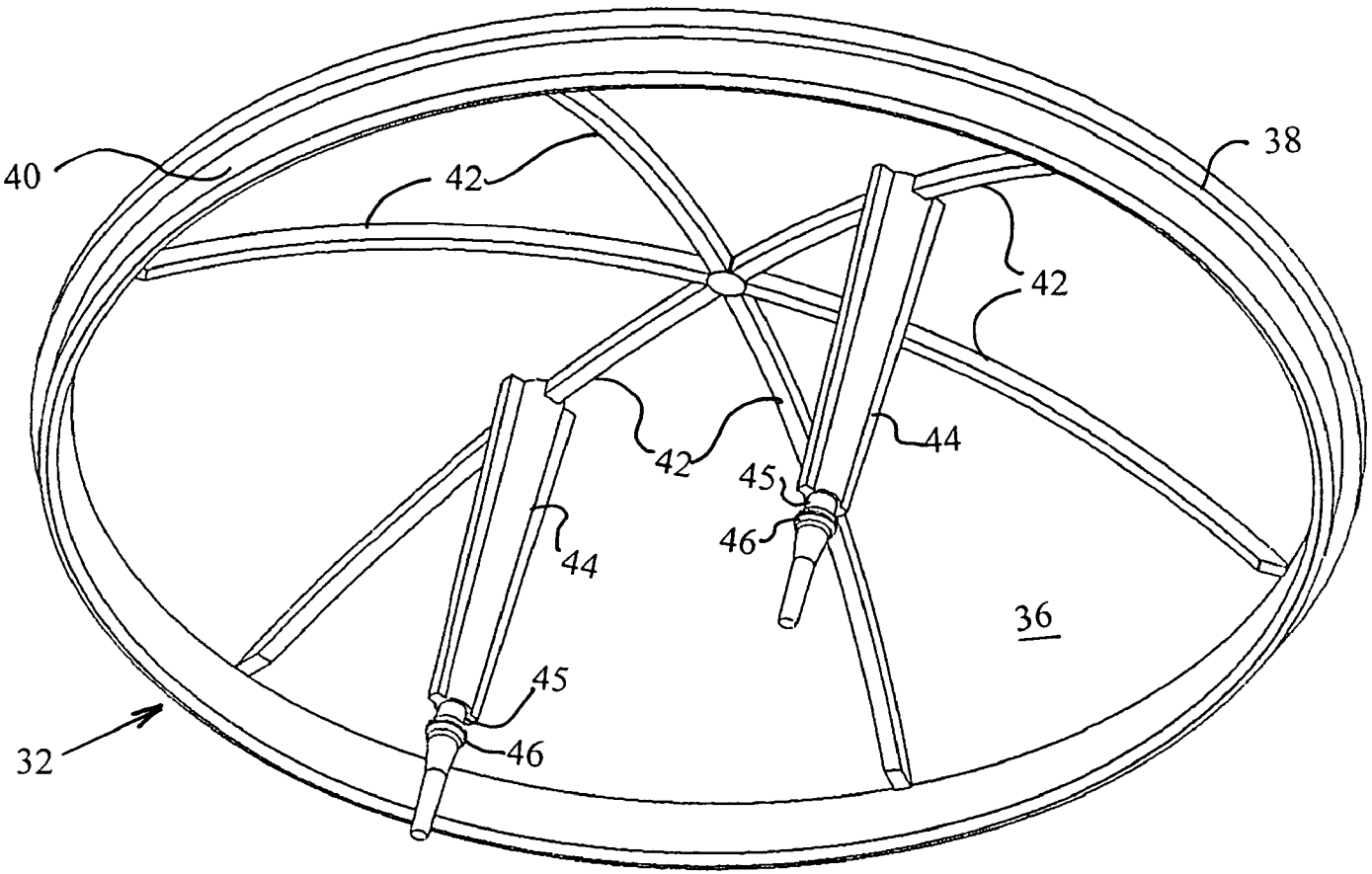
FIG. 7 is a perspective view of elliptical dome forming part of the actuator shown in FIG. 1.
Figure 8:
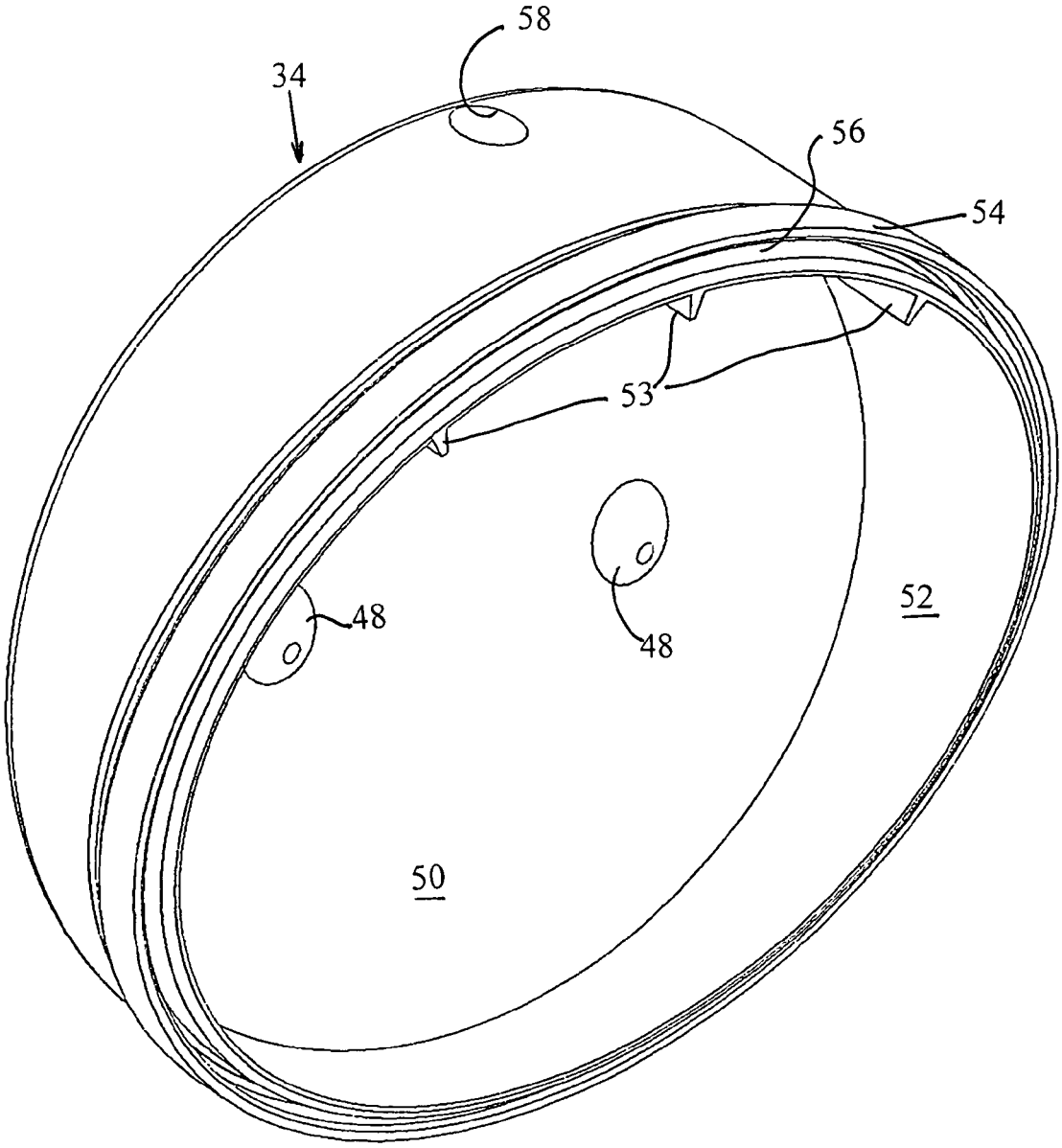
FIG. 8 is a perspective view of wedge shaped base forming part of the actuator shown in FIG. 1.

In FIG. 1 there is illustrated the preferred embodiment of the elliptical pneumatic actuator 10 according to the present invention. The elliptical pneumatic actuator 10 is connected in a manner per se well known in the art, by an air conduit 12 to a pneumatically actuated switching device 14 that is in turn connected electrically with a circuit, not shown, at some remote site for producing an alarm signal that is detected by personnel, such as a nurse. The present invention is particularly useful in a nurse call system utilized by patients to summon help for assistance or fulfill a need for patient care. The switch device 14 is shown in greater detail in FIGS. 2 and 3 and includes an actuator housing 16 having an internal annular cavity for supporting a sleeve 17. The sleeve 17 seats against a bottom wall of the cavity in the housing 16. The top of the cavity is enclosed by a porous air filter 18. Emerging through an opening surrounded by an enlarged boss 19 in a sidewall of the housing 16 there is a tubular conductor 21 having internally thereof an insulating sleeve 22. Each of opposite ends of the sleeve 22 is formed with an enlarged radial flange 23 that anchors the sleeve 22 within sleeve 21. A conductor pin 24 electrically interconnects sleeve 17 with sleeve 21. A conductor pin 25 is supported in the central opening of insulating sleeve 22 and provided with a hemispherical electrical contact 26 that is situated within a sidewall opening of sleeve 17 in a manner that contact 26 protrudes a slight distance beyond the internal wall face of sleeve 17. Connector 25 is provided with a threaded end portion that extends beyond the insulating sleeve 22 and receives a metal connector 27. As shown in FIG. 3, the actuator ball which can be of a solid metal construction or of a non-metallic core provided with a metallic covering can be displaced from the conical seat through the delivery of a quantity of pressurized air through duct 28 into the area surrounded by the sleeve 17. The ball 30 is displaced by the air from the conical seat into an electrically conductive relationship between the hemispherical head portion 26 of conductor 25 and the sleeve 17. When this occurs, the normally opened circuit condition as depicted by the arrangement of parts in FIG. 2 becomes a normally closed circuit condition as depicted by the arrangement of parts in FIG. 3 and thereby provide a corresponding electrical signal which is detectable by the call system to which the switching device 14 is connected.

A supply of pressurized air is delivered by conduit 12 to an entry duct 28, which comprises an extension of the housing 16. The entry duct has an external surface formed with anchor lugs that can firmly grip by partial penetration of the internal wall face of duct 12 in order to maintain an airtight connection between duct 12 and duct 28. A collar 29 is passed over the external surface of the duct 28 to apply a compressive force to the duct and reinforce the conduit sidewall. The internal cavity wherein sleeve 17 is supported in housing 16 is provided with a truncated conical seat surrounding the supply opening in the duct 28 for allowing an actuator ball 30 to seat by gravity against the truncated conical seating surface.

The preferred embodiment of the elliptical pneumatic actuator 10 according to the present invention is illustrated in detail in FIGS. 1 and 4-8 and includes an elliptical dome 32 joined to a wedge shaped base 34. The dome 32 has a convex actuating wall 36 terminating at an elliptical edge 38 where a generally perpendicular locking lip 40 encircles the actuating wall. The elliptical configuration of the dome, as shown in FIG. 1, is defined by a radii R1 struck from spaced apart points along a major axis A1 and intersecting minor axis A2 and at the point of intersection, the radii R2 are struck. The radii R1 and R2 are symmetrical about each of the respective major axis A1 and a minor axis A2 which are chosen so that, preferably, the ellipse can reside within a rectangle of about 5.125 inches by 4.100 inches whereby the dome encircles an unusually large surface area. The elliptical size of the dome is provided for the ease of an elderly or geriatric and convalescent care patients. The wedge shape design of the base requires very little effort use to pneumatic bulb of the present invention by the patient and the large elliptical surface area of the dome that can be made soft to the touch which provides convenience and reliable placement in a bed with the patient and less likely to get lost in the bed when the patient search for the pneumatic actuator. A patient to activate the switching device need only brush against the dome with their cheek or head but the device could be placed almost anywhere that motion can be directed to activate a call. Measures are provided to prevent collapse of the dome by providing self-sustaining support by reinforcing ribs 42 traversing the underside of the dome and terminating at the elliptical edge 38. Other measures include the provision of spaced apart support columns 44 having free ends each containing a shank 45 terminating at an enlarged anchor knot 46.

The base 34 includes spaced apart receptacles 48 each with an aperture 49 for receiving a shank 45 after passage of an anchor knot 46. The receptacles 48 take the form of concave anchor walls projecting toward the dome. The cavity of each receptacle 48 is supplied with a quantity of adhesive to secure and form an airtight seal with the anchor knot. In this manner, the dome is support by columns and anchored by the columns to a floor wall 50. The floor wall 50 is bounded by an elliptical perimeter wall 52 that is symmetrical about the same major axis A1 and minor axis A2 with the same Radii R1 and R2 as found in the construction of the dome. The perimeter wall 52 is an endless upstanding sidewall includes ribs 53 for self-sustaining support in the upstanding fashion. The wall 52 terminates at a projected edge 54 that varies continuously in height about one of the major axis A1 and the minor axis A2, preferably the minor axis A1. The wedge shaped configuration defined by the projected edge can vary continuously in height by a ratio of 3 to 1, with the projected edge lying in a plane forming an angle $\beta$ with a plane containing the floor wall 50 within the range of 10° and 20° preferably 15°. If desired, the projected edge 54 can vary continuously in height about the major axis A2.

The projected edge 54 is constructed with a U-shaped channel 56 and dimensioned to receive the locking lip 40 and secured by a suitable adhesive, not shown, to form an air tight assembly. It is within the scope of the present invention to reverse the construction of the interlocking lip 40 and U-shaped channel 56 by constructing the projected edge 54 with a locking lip 40 and dimensioned to be received in a U-shaped channel 56 constructed to extend generally perpendicular from the elliptical edge 38. Thus, one of a channel 56 and locking lip 40 reside on the projected edge 54 of the perimeter wall 52 and the other of the channel and the locking lip formed on the elliptical edge of the dome for interlocking engagement in an airtight fashion. An annular sleeve 58 is joined in an airtight fashion to the endless upstanding sidewall for receiving the duct comprising the air conduit 12.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

The invention claimed is:

1. A pneumatically actuated switching device comprising:

a dome with a convex actuating wall terminating at an elliptical edge and including spaced apart support columns protruding from a concave inner face surface of said convex actuating wall;

a base including receptacles for anchoring said support columns to a floor bounded by an elliptical perimeter symmetrical about each of a major axis and a minor axis and joined to an endless upstanding sidewall having a projected edge that varies continuously in height about one of said major axis and said minor axis, said projected edge having one of a channel and a locking lip and the other of said channel and said locking lip being formed on said elliptical edge for interlocking engagement in an air tight fashion; and an electrically conductive switch coupled by a duct for responding to a volume of pressurized air within said dome and said base by deflection of said convex actuating wall.

2. The pneumatically actuated switching device according to claim 1 wherein said spaced apart support columns have free ends containing enlargements defining anchor knots and said receptacles include apertures for receiving said anchor knots.

3. The pneumatically actuated switching device according to claim 2 wherein said receptacles include concave anchor walls projecting toward said dome between said endless upstanding side wall.

4. The pneumatically actuated switching device according to claim 1 wherein said projected edge varies continuously in height about said minor axis.

5. The pneumatically actuated switching device according to claim 1 wherein said projected edge varies continuously in height by a ratio of 3 to 1.

6. The pneumatically actuated switching device according to claim 1 wherein said endless upstanding sidewall defines a wedge shaped configuration to said base.

7. The pneumatically actuated switching device according to claim 6 wherein said endless upstanding sidewall lies in a plane forming an angle of between 10° and 20° with a plane containing said base.

8. The pneumatically actuated switching device according to claim 7 wherein said angle is 15°.

9. The pneumatically actuated switching device according to claim 1 wherein said concave inner face surface of said convex actuating wall includes ribs for self sustaining support of said convex actuating wall terminating at an elliptical edge.

10. The pneumatically actuated switching device according to claim 1 wherein said endless upstanding sidewall includes ribs for self-sustaining support in the upstanding fashion.

11. The pneumatically actuated switching device according to claim 1 further including an annular sleeve joined in an airtight fashion to said endless upstanding sidewall for receiving said duct.

* * * * *